US007185706B2

(12) United States Patent
Freyer

(10) Patent No.: US 7,185,706 B2
(45) Date of Patent: Mar. 6, 2007

(54) ARRANGEMENT FOR AND METHOD OF RESTRICTING THE INFLOW OF FORMATION WATER TO A WELL

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 10/477,440

(22) PCT Filed: Apr. 26, 2002

(86) PCT No.: PCT/NO02/00158

§ 371 (c)(1),
(2), (4) Date: Mar. 29, 2004

(87) PCT Pub. No.: WO02/090714

PCT Pub. Date: Nov. 14, 2002

(65) Prior Publication Data

US 2004/0144544 A1 Jul. 29, 2004

(30) Foreign Application Priority Data

May 8, 2001 (NO) ..... 20012261

(51) Int. Cl.
*E21B 43/12* (2006.01)
*E21B 34/08* (2006.01)

(52) U.S. Cl. ..... 166/369; 166/265; 166/54

(58) Field of Classification Search ..... 166/54, 166/265, 369
See application file for complete search history.

(56) References Cited

U.S. PATENT DOCUMENTS 1,362,552 A * 12/1920 Alexander et al. ..... 166/54
1,649,524 A * 11/1927 Hammond ..... 166/54

(Continued)

FOREIGN PATENT DOCUMENTS

CN 1385594 A * 12/2002

(Continued)

OTHER PUBLICATIONS

Norwegian Search Report for patent application No. 2001 2261 dated Sep. 28, 2001.

(Continued)

*Primary Examiner*—Jennifer H. Gay
*Assistant Examiner*—Shane Bomar
(74) *Attorney, Agent, or Firm*—Marlin R. Smith

(57) ABSTRACT

An arrangement for restricting the inflow of formation water from an underground formation to a hydrocarbon producing well, where, between the underground formation and a production tubing (38) located in the well, there is disposed at least one flow chamber (3, 33) connected to the production tubing (38), the flow chamber (3, 33), preferably via a filter (2) in one portion, being open to inflow of formation fluid and in communication with the production tubing (38) via at least one opening (7, 32), and where the flow chamber (3, 33) is provided with at least one free-floating body (4, 34) with approximately the same density as the formation water, the at least one body (4, 34) being designed by means of the closing of at least one opening (32) or choking, to reduce the inflow of formation water to the production tubing (38).

12 Claims, 1 Drawing Sheet

U.S. PATENT DOCUMENTS

| | | | | | |
|---|---|---|---|---|---|
| 2,089,477 | A | | 8/1937 | Halbert | |
| 2,214,064 | A | * | 9/1940 | Niles | 166/54 |
| 2,257,523 | A | * | 9/1941 | Combs | 417/116 |
| 2,412,841 | A | * | 12/1946 | Spangler | 210/435 |
| 2,762,437 | A | | 9/1956 | Egan et al. | |
| 2,810,352 | A | * | 10/1957 | Tumlison | 166/54 |
| 3,791,444 | A | * | 2/1974 | Hickey | 166/54 |
| 4,173,255 | A | * | 11/1979 | Kramer | 166/369 |
| 4,287,952 | A | | 9/1981 | Erbstoesser | |
| 4,491,186 | A | * | 1/1985 | Alder | 175/26 |
| 4,497,714 | A | * | 2/1985 | Harris | 210/788 |
| 4,974,674 | A | * | 12/1990 | Wells | 166/107 |
| 4,998,585 | A | * | 3/1991 | Newcomer et al. | 166/105 |
| 5,333,684 | A | | 8/1994 | Walter et al. | |
| 5,337,821 | A | | 8/1994 | Peterson | |
| 5,435,393 | A | | 7/1995 | Brekke et al. | |
| 5,673,751 | A | | 10/1997 | Head et al. | |
| 5,873,410 | A | | 2/1999 | Iato et al. | |
| 6,112,815 | A | | 9/2000 | Bøe et al. | |
| 6,253,861 | B1 | | 7/2001 | Carmichael et al. | |
| 6,305,470 | B1 | | 10/2001 | Woie | |
| 6,367,547 | B1 | * | 4/2002 | Towers et al. | 166/265 |
| 6,516,888 | B1 | | 2/2003 | Gunnarson et al. | |
| 2005/0016732 | A1 | * | 1/2005 | Brannon et al. | 166/308.1 |

FOREIGN PATENT DOCUMENTS

| | | |
|---|---|---|
| GB | 2341405 | 3/2000 |
| WO | WO/02075110 | 9/2002 |

OTHER PUBLICATIONS

International Preliminary Examination Report for PCT/NO02/00158.

International Search Report for PCT/NO02/00158.

* cited by examiner

ARRANGEMENT FOR AND METHOD OF RESTRICTING THE INFLOW OF FORMATION WATER TO A WELL

CROSS REFERENCE TO RELATED APPLICATION

The present application is the U.S. national stage application of International Application PCT/NO02/00158, filed Apr. 26, 2002, which international application was published on Nov. 14, 2002 as International Publication WO 02/090714. The International Application claims priority of Norwegian Patent Application 200012261, filed May 8, 2001.

FIELD OF THE INVENTION

This invention regards an arrangement for and a method of automatically controlling the inflow of formation water to a petroleum well by means of buoyancy elements.

BACKGROUND OF THE INVENTION

Oil and gas production will in most cases have to be stopped when the water production from a well becomes excessive. The time of water breakthrough will vary from one zone to the next, and will also depend on the measured depth of the zone due to flow pressure drop. If a zone that mainly has an inflow of water is choked, the production from zones producing mainly oil may be increased. As a result, systems have been produced in recent years which comprise valves and adjustable nozzles controlled from the surface. These are technically complex systems that require a great amount of downhole equipment, and which have so far shown poor reliability. Also, the potential for using more than 4–5 valves in each well is limited. In addition, the flow area of the production tubing is small, limiting the production.

As a simple alternative to this, a nozzle or ducting system has been developed in which the production is restricted regardless of whether the inflow consists of oil or water. Examples of this are seen in U.S. Pat. Nos. 6,112,815 and 5,435,393. The arrangements according to these documents may counter frictional effects caused by the flow of fluid flowing through the production tubing, but will not regulate the pressure drop across the system on the basis of the water cut in the wellstream. According to these patents, the produced fluids flow through a fixed flow restriction such as a capillary tube or nozzle, before flowing into the tubing. These capillary tube devices have typically been arranged around the production tubing as a helical thread where the fluid flows in the grooves of the thread.

U.S. Pat. No. 5,333,684 discusses a tool for drawing gas out of a well without simultaneously producing water. The tool is equipped with spherical, stacked controlled buoyancy elements, where the density of the buoyancy elements is lower than that of water. Upon outflow of water from the well, the elements ascend and close an opening, preventing water from flowing out of the well.

SUMMARY OF THE INVENTION

According to the invention, there is provided a restriction arrangement and a method defined in the claims.

The inflow of formation water from a well to a production tubing may be reduced by the hydrocarbon production in the well, e.g. within a 12 m long length of piping, flowing into one or more chambers connected to the production tubing. From the chamber, the oil flows on into the production tubing via a number of through nozzles in the tubing wall. A number of balls are disposed in the chamber. The balls have approximately the same density as the formation water. On production of oil, the balls will have a low mobility, as they have a density that is significantly higher than that of the oil; thus they will sink. The density of the oil is typically less than 900 kg/m3, while the water will have a density of approximately 1000 kg/m3. On partial production of water, these balls will have neutral buoyancy in the water and close nozzles through which there is a flow of formation water. Alternatively, the balls may aggregate and reduce the flow through the chamber.

Optionally, oil and formation water may flow through bypass nozzles that can not be closed by balls. These bypass nozzles will reduce the control effect, so that the production is not stopped completely, even at a high water cut. If the well zone in question produces only water, only nozzles that are not closed by balls will produce well fluid.

Arrangements according to the invention may be positioned at relatively short intervals along the production tubing, whereby the fluid production in zones experiencing inflow of water is reduced. The arrangements operate independently of each other and with immediate response. Thus is achieved greater selectivity and better control than when using surface controlled systems.

When compared with prior art, the flow pressure drops in the production tubing are considerably smaller, in as much as greater production tubing dimensions may be used. The reliability is improved, the installation work is reduced, and the costs are lower due to simpler technology with a total absence of cables, cable connections and moving high-precision mechanics and hydraulics.

DETAILED DISCLOSURE THE INVENTION

Figure 1:
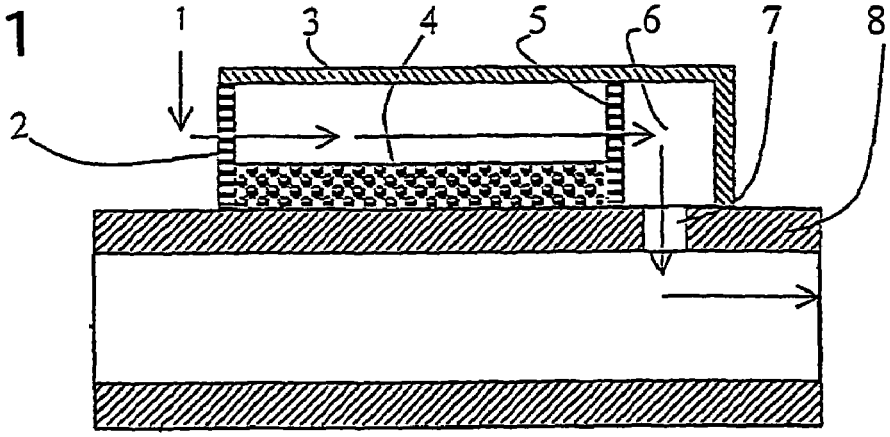
FIG. 1 is a cross-sectional view of an arrangement for restricting the inflow of formation water, the arrangement embodying principles of the present invention.

For a clearer understanding of the invention, it will be described in the form of embodiments illustrated in the appended drawings, in which:

FIG. 1 shows a case where an oil stream 1 passes through a filter 2 and then into a flow chamber 3. A number of balls 4 are located at the lower side of this chamber due to the balls being heavier than the oil. The oil further flows through a filter 5 and into a space 6, in order to flow on through openings 7 and into the production tubing 8, then to follow the flow of oil up through the well.

Figure 2:
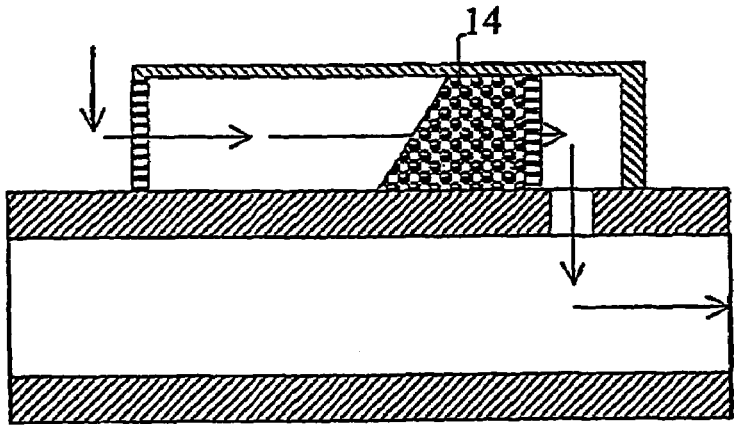
FIG. 2 is a cross-sectional view of the arrangement for restricting the inflow of formation water, wherein an aggregate of balls has formed due to water flow through the arrangement.

FIG. 2 shows the same construction as FIG. 1, the difference being that here, water is flowing. The balls are now packed vertically, since the balls have neutral buoyancy. Thus is formed an aggregate 14 of balls causing a pressure drop in the flow.

Figure 3:
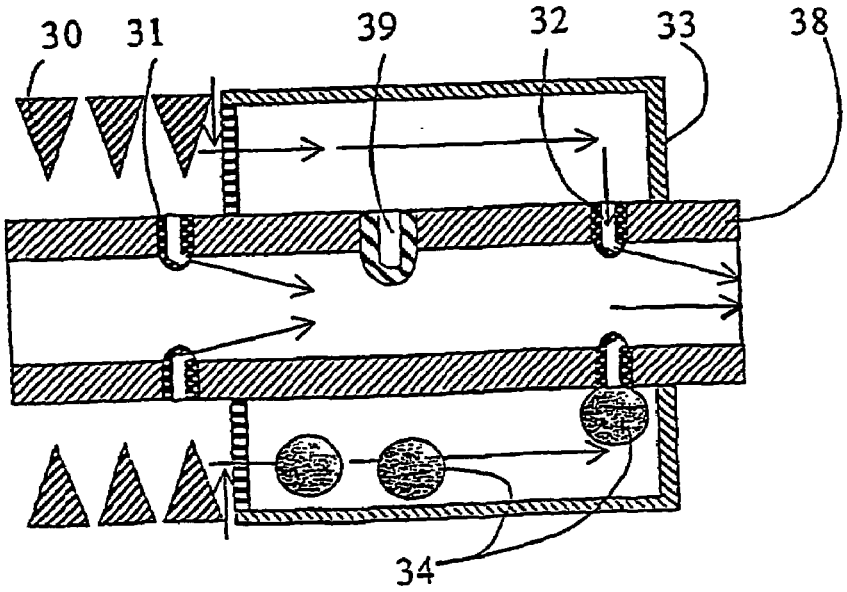
FIG. 3 is a cross-sectional view of an alternate construction of the arrangement for restricting the inflow of formation water.

FIG. 3 shows an annular sand filter 30, a bypass nozzle with a hole 31 in a production tubing 38, as well as an annular chamber 33 with balls 34, in which the balls 34 have approximately the same density as the formation water. One of these balls is shown sealing one of the nozzles 32. In addition, there is shown a plug 39 made from a drillable or acid/base soluble material, with a borehole extending almost through the plug. When the tip of this plug is removed during a well intervention, e.g. by means of a drill bit run on coiled tubing at a later stage in the lifetime of the well, the produced fluids will flow more easily into the well.

The invention claimed is:

1. An arrangement for restricting inflow of formation water from an underground formation into a tubing in a well, the arrangement comprising:

at least one flow chamber connected to the tubing, the flow chamber being open to inflow of formation fluid and in communication with the tubing via at least one opening, wherein the flow chamber is provided with at least one body with substantially neutral buoyancy in the formation water, and wherein the body is operative to reduce the inflow of the formation water into the tubing by increasingly obstructing the opening in response to increased production of formation water.

2. An arrangement for restricting inflow of formation water from an underground formation into a tubing in a well, the arrangement comprising:

at least one flow chamber connected to the tubing, the flow chamber being open to inflow of formation fluid and in communication with the tubing, wherein the flow chamber is provided with multiple bodies with substantially neutral buoyancy in the formation water, the neutral buoyancy bodies being arranged in the flow chamber, wherein the bodies are operative to reduce the inflow of the formation water into the tubing, and wherein the bodies through aggregation to a packed form are operative to choke flow of the formation water through the flow chamber.

3. An arrangement for restricting inflow of formation water from an underground formation into a tubing in a well, the arrangement comprising:

at least one flow chamber connected to the tubing, the flow chamber being open to inflow of formation fluid and in communication with the tubing, wherein the flow chamber is provided with at least one body with substantially neutral buoyancy in the formation water, and wherein the body is operative to reduce the inflow of the formation water into the tubing, and wherein a plug is disposed between the flow chamber and an interior of the tubing, which plug projects into the tubing, the plug being provided with a non-through bore extending from the flow chamber into the interior of the tubing, an inwardly projecting end portion of the plug being removable, whereby the bore of the plug is opened to flow.

4. An arrangement for restricting inflow of formation water from an underground formation into a tubing in a well, the arrangement comprising:

at least one flow chamber connected to the tubing, the flow chamber being open to inflow of formation fluid and in communication with the tubing, wherein the flow chamber is provided with at least one body with substantially neutral buoyancy in the formation water, and wherein the body is operative to reduce the inflow of the formation water into the tubing, and wherein the tubing is provided with at least one opening permitting inflow of the formation fluid, the opening being external to the flow chamber in which the neutral buoyancy body is disposed.

5. A method of restricting inflow of formation water from an underground formation into a tubing in a well, the method comprising the steps of:

positioning between the underground formation and the tubing at least one flow chamber connected to the tubing, the flow chamber being open to inflow of formation fluid and in communication with an interior of the tubing via at least one opening;

flowing hydrocarbons through the flow chamber, bodies in the flow chamber having substantially neutral buoyancy in the formation water permitting flow of the hydrocarbons through the opening; and flowing the formation water through the flow chamber thereby causing the bodies to restrict flow of the formation water from the flow chamber to the interior of the tubing by increasingly obstructing the opening in response to increased production of the formation water.

6. An arrangement for restricting inflow of formation water from an underground formation into a tubing in a well, the arrangement comprising:

a flow chamber having at least one body therein, the body having substantially neutral buoyancy in the formation water, and wherein the body is operative to increasingly restrict flow from the flow chamber to an interior of the tubing in response to an increased proportion of formation water in the flow chamber.

7. The arrangement of claim 6, wherein the body is operative to increasingly restrict flow from an exterior of the tubing to the interior of the tubing in response to the increased proportion of formation water in the flow chamber.

8. The arrangement of claim 6, wherein multiple bodies form an aggregate to thereby increasingly restrict flow from the flow chamber to the interior of the tubing in response to the increased proportion of formation water in the flow chamber.

9. The arrangement of claim 6, wherein the body closes off at least one opening to thereby prevent flow from the flow chamber to the interior of the tubing in response to the increased proportion of formation water in the flow chamber.

10. The arrangement of claim 6, wherein a filter is positioned upstream of the flow chamber.

11. The arrangement of claim 6, wherein at least one opening permits flow between an exterior of the tubing and the interior of the tubing external to the flow chamber.

12. The arrangement of claim 6, wherein at least one opening is selectively openable to thereby permit flow between the flow chamber and the interior of the tubing.

* * * * *